United States Patent [19]

Samuelsson

[11] 4,249,409

[45] Feb. 10, 1981

[54] BENCH ALIGNER

[75] Inventor: Mökjas J. Samuelsson, Orebro, Sweden

[73] Assignee: Josam Lastbilteknik AB, Orebro, Sweden

[21] Appl. No.: 28,224

[22] Filed: Apr. 9, 1979

[30] Foreign Application Priority Data

Apr. 12, 1978 [SE] Sweden ..... 7804107

[51] Int. Cl.[3] ..... B21D 1/12

[52] U.S. Cl. ..... 72/305; 72/446; 72/705; 269/71

[58] Field of Search ..... 267/71, 73; 72/305, 72/311, 446, 447, 705

[56] References Cited

U.S. PATENT DOCUMENTS

| | | | |
|---|---|---|---|
| 2,542,836 | 2/1951 | Porter et al. | 72/705 |
| 3,292,410 | 12/1966 | Baldassano | 72/705 |
| 3,625,047 | 12/1971 | Lunardini | 72/705 |

*Primary Examiner*—Lowell A. Larson

*Attorney, Agent, or Firm*—Strimbeck, Davis & Soloway

[57] ABSTRACT

The invention relates to a straightening jig for vehicle bodies, particularly for the cabs of trucks, of the kind comprising a stand for fastening to a floor or other foundation, and being equipped with a number of bearing fixings in which a number of bearing components on a vehicle body are intended to fit and be fixed when the vehicle body is located on the jig.

The invention is characterized in that the stand is provided with guideways for at least one alignment bar which is displaceably arranged in the jig and which extends in the longitudinal direction of the jig, in that the alignment bar is provided with at least one bearing fixing in which a bearing component on the vehicle body is fitted when the vehicle body is located in the jig, in that the alignment bar is arranged so that it can carry out displacement movements in the guideways both in the longitudinal and transverse directions of the alignment bar, preferably with the aid of servo-controlled operating devices, and in that the relative position of the alignment bar in the stand can be locationally fixed when the alignment bar is moved into a given position for the bearing components of the vehicle body in the stand of the jig.

16 Claims, 5 Drawing Figures

BENCH ALIGNER

The present invention relates to a straightening jig for vehicle bodies or the like, preferably the driver's cabs of heavy trucks, this straightening jig comprising a stand for fastening to a floor foundation or to another foundation and being equipped with a number of bearing fixings in which a number of bearing components on the vehicle body are intended to fit and be fixed when the vehicle body is put in position in the straightening jig.

For straightening a damaged vehicle cab it is necessary at the start of the straightening work that the cab is held in a position so that it can be straightened back to its original shape as far as the most important basic points in the structure of the cab are concerned. For such a purpose it is customary in workshops to use a straightening jig in which the cab is clamped fast with the aid of locking devices. The said basic points can vary in different cab structures, but as a rule they consist of two front and two rear laterally situated fixing points in the cab.

On the forwards-tilting vehicle cabs which are now usual on trucks, the front fixing points can consist of the bearing component for the axle pins or the ends of the axle round which the vehicle cab is designed to rotate during a tilting movement, and the back fixing points can consist of two groups of holes located in the lower part of the back of the cab, for fixing the cab to a vehicle frame or the like with the aid of screw connections, the fixing points being symmetrically located on either side of the longitudinal centre line through the cab. With the cab thus fixed in the straightening jig the straightening operations can thereafter be carried out with the aid of mechanical and/or servo-controlled straightening means.

If damage to the vehicle cab has caused changes in the relative positions of the said fixing points, before fixing the cab in the straightening jig it is necessary to carry out preparatory straightening operations in this respect. The methods known until now for such straightening are very complicated and time-consuming and if no effective straightening equipment is available it is necessary to resort to manual straightening operations, which require a great deal of skill to carry out. Even with access to known straightening equipment, the preparatory straightening presents a difficult problem for workshops, since it requires great precision to adjust the fixing points in the cab structure correctly in relation to each other without any distortion arising. The fixing points can be moved in both the vertical direction and the horizontal direction, and in this case it is also very hard to determine the position of the fixing points relative to each other with conventional measuring devices.

The present invention has a view to remedying difficulties of this kind and to provide a straightening jig in which the fixing points in the structure of a vehicle body are positioned relative to each other before subsequent straightening operations, and in which straightening jig preparatory straightening operations can also be carried out if the relative positions of the fixing points have been displaced relative to each other due to the effects of damage. In this respect, the straightening jig according to the invention is characterised in that the stand is provided with guideways for at least one alignment bar arranged displaceably in the straightening jig and having extension in the longitudinal direction of the straightening jig, that the alignment bar is provided with at least one bearing fixing or the like in which a bearing component on the vehicle body is fitted when the vehicle body is placed in the straightening jig, that the alignment bar is arranged so that it can carry out displacement movements in the guideways both in the longitudinal direction of the alignment bar and in its transverse direction, preferably with the aid of servo-controlled operating devices, and that the relative position of the alignment bar in the stand can be locationally fixed when the alignment bar takes up a given position for the bearing components of the vehicle body in the stand of the straightening jig.

Advantageously, the straightening jig comprises two displaceably arranged alignment bars, which in each two fixed guideways of the stand take up substantially parallel positions with a distance between them which corresponds generally to the distance between the two front bearing components of the vehicle body. The straightening jig may be further characterised in that the alignment bar has guide tracks and/or guide holes for locking the alignment bar, for example, by means of pins, in a specific position corresponding to a given position in the stand of the straightening jig.

The stand in the straightening jig according to the invention may consist expediently of a lower frame and an upper frame rigidly connected together, each of the frames comprising at least two longitudinally extending beams and at least two transversely extending beams, forming an inner rectangular frame with the transverse beams projecting out freely at the sides of the respective inner frames. The transverse beams of the upper frame may be located inside the transverse beams of the lower frame and the upper frame may be connected symmetrically on the lower frame in the transverse direction, so that the longitudinal beams of the upper frame are located inside the longitudinal beams of the lower frame.

In the rear part of the straightening jig the stand may be formed with an upright beam with two seats formed on its upper face for stud-mounting the rear part of the vehicle body.

Other characteristics which distinguish the invention will be found in the appended Patent Claims and also in the following description one constructional form, taken by way of example, of the invention.

The description is given with reference to the accompanying drawings, in which.

Figure 1:
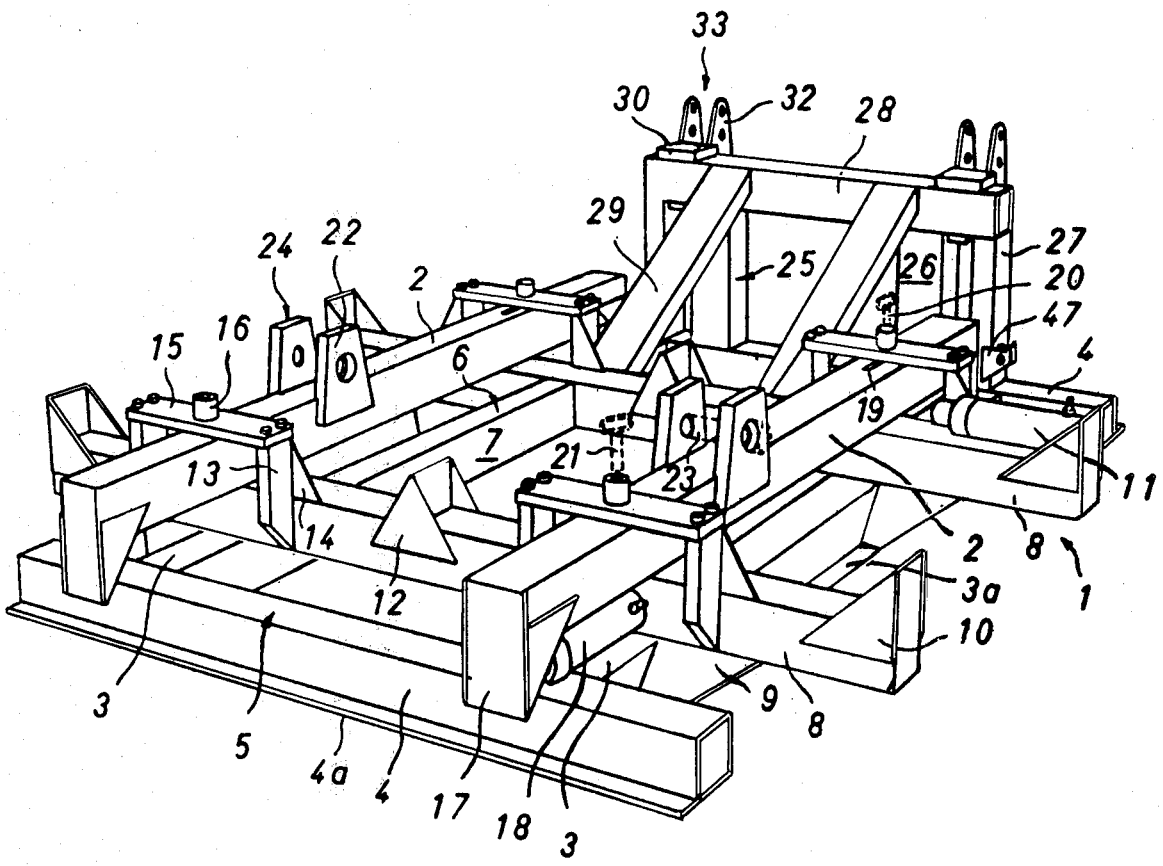
FIG. 1 is a perspective view of a straightening jig according to the invention.
Figure 2:
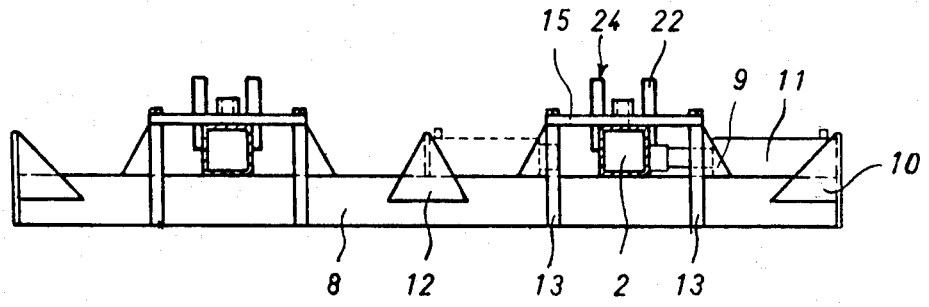
FIG. 2 is a longitudinal view of a transverse beam in the stand of the straightening jig and two alignment bars arranged movably therein.
Figure 3:
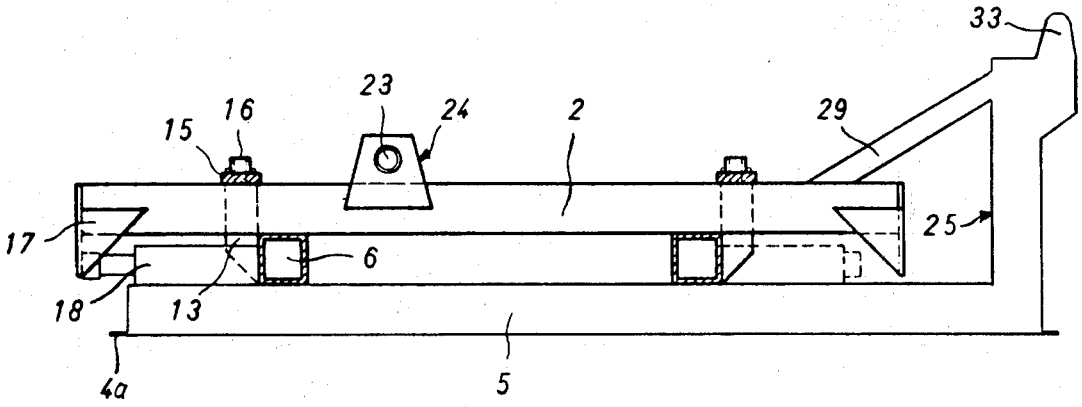
FIG. 3 is a longitudinal view of an alignment bar.
Figure 4:
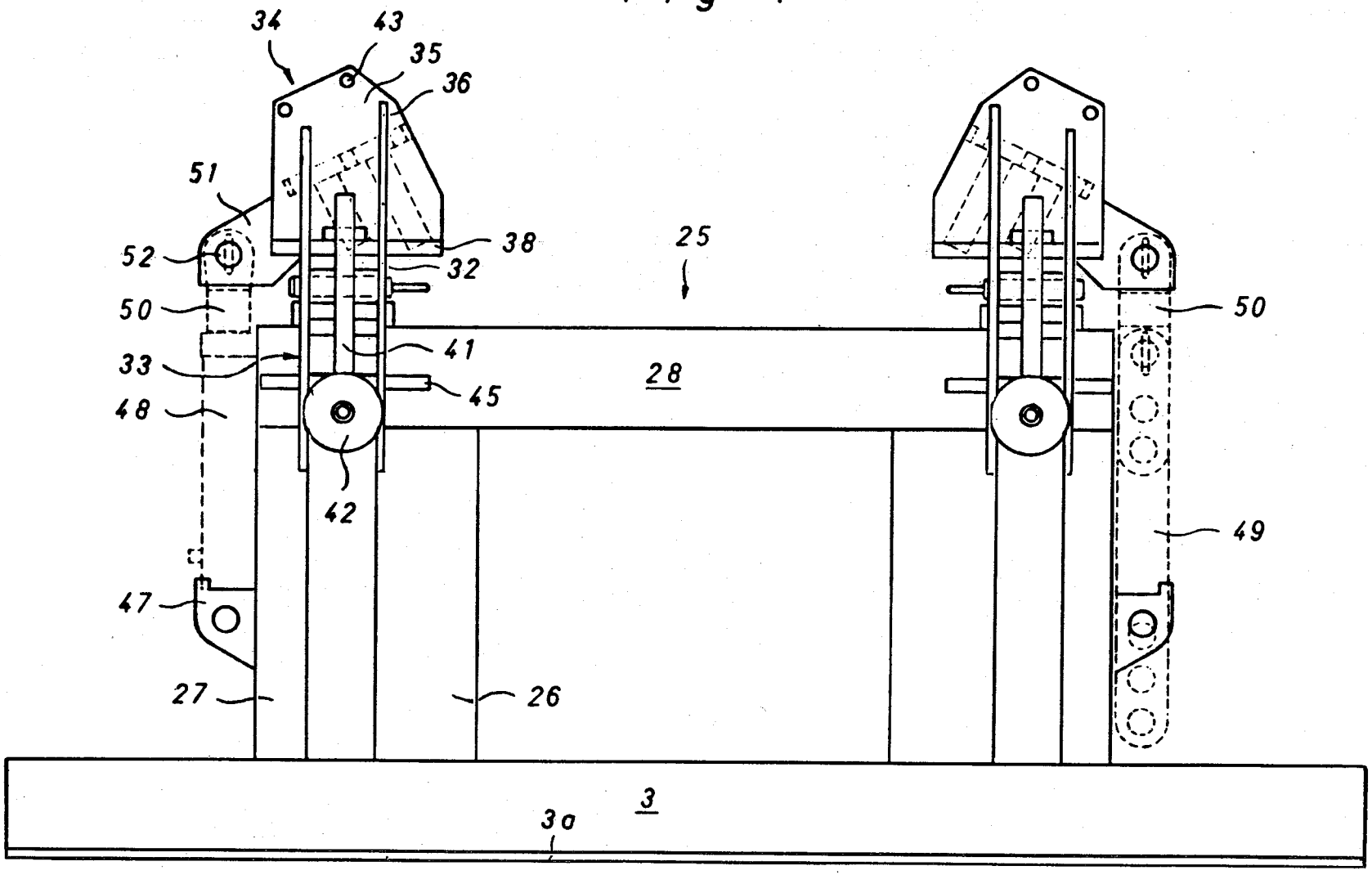
FIG. 4 is a rear end view of the straightening jig with a clamping device connected to it.
Figure 5:
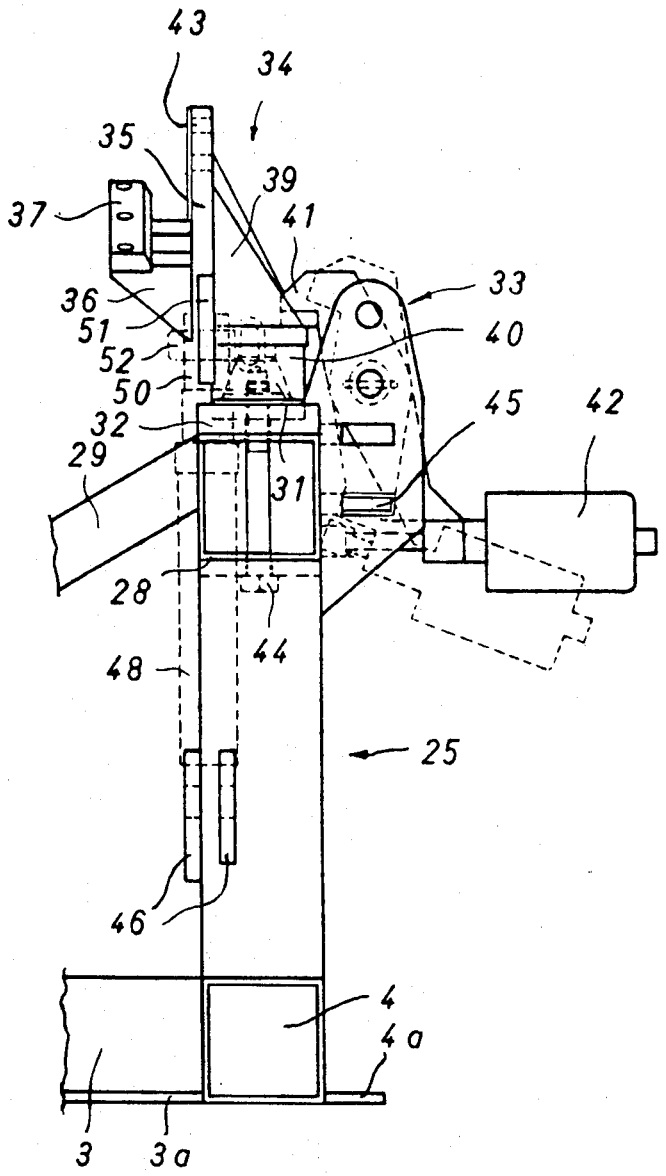
FIG. 5 is a side view of the said clamping device and the rear beam in the straightening jig.

The straightening jig shown by way of example consists mainly of a stand 1 and two alignment bars 2 disposed movably therein. The stand 1 is designed to rest on and be fixed to a floor foundation or the like and can be seen to be made up of a lower frame 5 and an upper frame 6. The lower frame 5 comprises two longitudinally extending beams 3 and two transverse beams 4. The beams 3, 4 are made from four-sided tube and are welded together, with the longitudinally extending beams 3 arranged between the transverse beams 4 to form a rectangular supporting frame with the end sections of the transverse beams 4 projecting freely and symmetrically at the sides of the rectangular supporting frame. Level with the plane of their base the respective beams 3, 4 have, at least on their faces on the outside of the stand 1, a fixed flange *3a, 4a*, which widens the contact surface of the beams 3, 4 on the foundations and makes it easier to fix the stand 1 to the foundations. The stand 1 is designed to be clamped down resting on the floor of a workshop or the like by means of mechanical and/or servo-controlled clamping devices (not shown), which are advantageously fitted in guide rails disposed permanently in the floor (these are not shown), and thereafter pressed down via the flanges *3a, 4a* on the respective beams 3, 4 in the lower frame 5.

The upper frame 6 is built up in the same way as the lower frame 5 and comprises two longitudinally extending tubular beams 7 and two transversely extending tubular beams 8 which are welded together with the longitudinally extending beams 7 between the transverse beams 8, forming a rectangular frame with the end sections of the transverse beams 8 projecting freely at the sides of the actual frame 6. The upper frame 6 is significantly shorter in the longitudinal direction than the lower frame 5, and in the transverse direction the longitudinally extending beams 7 in the upper frame 6 are located within the corresponding longitudinally extending beams 3 in the lower frame 5. Also in the transverse direction, the transverse beams 8 in the upper frame 6 are advantageously slightly longer than the transverse beams 4 in the lower frame 5.

Resting on the upper face of the longitudinal beams 3 of the lower frame 5, the transverse beams 8 of the upper frame 6 are welded firmly to the lower frame 5 so that, at least in the transverse direction, the upper frame 6 takes up a symmetrical position relative to the lower frame 5. The transverse beams 8 in the upper frame 6 thereby take up longitudinal positions lying within the transverse beams 4 of the lower frame at a distance which, at their respective ends, corresponds to at least one fifth of the length of the lower frame 5. The welding together of the upper frame 6 and the lower frame 5 is also carried out with the aid of triangular support plates 9 which are welded in pairs both on the outer faces of the rectangular lower frame 5 and on the lower faces of the transverse beams 8 in the upper frame 6, thereby forming a bracing stay.

At their respective ends the transverse beams 8 in the upper frame 6 have end pieces 10 welded on the upper surface, which form an abutment surface and mounting for a hydraulic cylinder 11 which acts on the alignment bar 2 towards the centre of the straightening jig and which is fitted on top of the upper frame 6 in the longitudinal direction of the transverse beams 8 for carrying out straightening operations. For the same purpose, in the centre of the respective transverse beams 8 of the upper frame 6 a bracket-like support 12 is welded, which forms an abutment surface and mounting for the hydraulic cylinder 11 acting on either side of the alignment bar 2.

Moreover, on the outside of each transverse beam 8 in the upper frame 6 there are two bearing plates 13 arranged upright in pairs. They rest on edge on one side of the transverse beam and for the purpose to strengthen the connection between the bearing plates 13 and the respective transverse beam 8 a triangular support plate 14 is welded on in the longitudinal direction of the transverse beams 8. On the upper face of two paired bearing plates 13 a bridge 15 is attached by means of screws, so that the bearing plates 13 and the bridge 15 form together a closed mounting which forms the guideway for an alignment bar 2. Relative to the longitudinal centre line of the upper frame 6, these loop-shaped guideways 13, 15 are arranged symmetrically, so that the lateral position of a guideway 13, 15 on the front transverse beam 8 corresponds with the lateral position of a guideway 13, 15 on the rear transverse beam 8. In the centre of each bridge 15 a boss 16 is attached with a hole which passes through the boss 16 and the bridge 15 and forms the mounting for a locking pin 20, 21.

As will be realised from the above, the two guideways 13, 15 are arranged on each transverse beam 8, which means that the two alignment bars 2 which extend substantially parallel can be fitted on the upper frame 6. Each alignment bar 2 is made from four-sided material and has a longitudinal extent which is longer than the longitudinal extent of the upper frame 6. In the normal position each alignment bar 2 is designed to take up a symmetrical longitudinal position on the upper frame 6 and an intermediate position in the transverse direction in the respective guideways 13, 15. On the lower face of the respective ends of each alignment bar 2 an end piece 17 is welded, forming an abutment surface and mounting for a hydraulic cylinder 18 acting in the longitudinal direction, which can be attached to the upper face of a longitudinally extending beam 3 in the lower frame 5 for straightening operations, supported on a transverse beam 8 in the upper frame 6. In the longitudinal position corresponding to the rear transverse beam 8 in the upper frame 6, each alignment bar 2 has a longitudinally extending guide track 19 in its upper surface. In this guide track 19 a rear pin 20 mounted in the bridge 15 and the boss 16 is designed to engage when the alignment bar 2 takes up a lateral position in the guideways corresponding to the mounting in the bridge 15. In the same way, a front pin 21 is designed to engage in an upper hole (not shown) in the alignment bar 2 when this takes up a lateral position and a longitudinal position in the front guideway 13, 15 corresponding to the lateral position and longitudinal position of the pin 21 in the stand 1.

In a position between the transverse beams 8 in the upper frame 6 each alignment bar 2 is provided with two bearing plates 22 welded on the sides, and extending upwards and forming together a bearing fixing 24 for a transversely extending axle pin 23. These axle pins 23 are designed to replace the axis of rotation of a forwards-tilting vehicle cab in the straightening jig. The axle pins 23 can be considered as forming the fundamental fixing points relative to which the straightening operations may be carried out on a vehicle cab. If the corresponding fixing points in a vehicle have been displaced due to the effects of damage, with the straightening jig according to the invention it is possible to carry out preparatory straightening operations so that the fixing points can be restored to their correct mutual relationships. The method will be described in more detail later, in conjunction with a subsequent description of the function.

For carrying out straightening operations in the straightening jig it is necessary to clamp the vehicle cab at its rear part as well. For this, the lower frame 5 of the stand 1 is made with a rear upright beam 25 consisting of four vertical beam elements 26, 27 which are welded at the base to the rear transverse beam 4 of the lower frame 5 and which are welded at the top to a transverse beam 28 disposed above. All the beam elements 26, 27, like the transverse beam 28, are made of four-sided tube. To brace the upright beam 25, two tubular stays 29 are attached by welding between the upper beam 28 and the outside of the rear transverse beam 8 in the upper frame 6.

To the upper face of both ends of the upper transverse beam 28 a bearing fixing 33 is welded, comprising a bearing plate 30 with a cylindrical seat in it for a guide stud 31, the upper part of which is formed as a truncated cone. On the rear part of each of these plates 30 on the respective sides of the seating hole two upright bearing plates 32 are welded, which are also welded on their edges to the rear face of the transverse beam 28 disposed above, and to the respective vertical beam element 26, 27. The bearing plates 32, which are attached in pairs, form together with the bearing plates 30 two bearing fixings 33 for means which can be connected to the upright beam 25 for fixing the rear part of the cab in the straightening jig.

For this purpose, two brackets 34 are used. Both the brackets 34 are made with a vertical supporting plate 35 to which two outstretched arms 36 are welded. The front ends of the arms 36 bear jointly a transverse rail 37, so that between the support plate 35 and this rail 37 there is a pocket in which the rear bodywork plate of the cab can engage and be locked with the aid of a number of screws and/or bolts which pass through through-bores 43 in each support plate 35 and in the holes which already exist in the bodywork plate of the cab, for fastening the cab in the normal way to a vehicle. The support plate 35 is rigidly connected by welding to a baseplate 38 and between the rear face of the support plate 35 and the baseplate 38 two stiffening struts 39 are welded. On the underside of the baseplate 38 a boss 40 is welded, which has a conical recess and forms a seat for positioning the brackets 34 on a guide stud 31 fitted to the upright beam 25. The stud is preferably fixed from the lower side with a locking screw 44 passing through the transverse beam 28 disposed above and the bearing plate 30.

From the above it will be appreciated that the rear part of the cab is fixed in the straightening jig by bringing the brackets 34 attached to the cab to rest with their conical contact surface over the guide studs 31 attached to the upright beam 25. To maintain such a position, in the respective bearing fixings 33 a two-armed lever 41 is mounted rotatably, with its upper arm resting on the upper face of the baseplate 38 of the brackets under the effect of a clamping force acting on the lower arm of the lever 41. This locking force can be obtained by fitting a transverse wedge 45 between the bearing plates 32 in the bearing fixing 33, so that the ends of the wedge 45 fit into the rectangular track in the bearing plates 32 and force the wedge 45 down onto the inner edge face on the lever 41. The locking force can also be obtained with a conventional servo-controlled clamping device 42, which is preferably attached to the lower arm of the lever 41 and, supported on the upright beam 25, acts on the lever 41 to give a mechanical clamping effect.

The straightening jig according to the invention can be adapted to different vehicle cabs and to this end the height of the guide studs 31 can be varied, and similarly the bearing plates 32 in the bearing fixings 33 are made with two alternative tracks for the wedges 45 and with two alternative mounting holes for the lever 41. To the same end, the bearing fixing 24 on the alignment bars 2 allows cabs with different clamping widths for the bearing components disposed in the respective cabs to be fixed in position. This type of adaptation is made possible by fitting an intermediate spacer (not shown) either on the inside or on the outside of a bearing component which has been inserted between the bearing plates 22. Similarly, the front guide hole (not shown) in the alignment bar 2 can consist of a number of alternative holes, so that the straightening jig can also be used for cabs of different length. To sum up, with the straightening jig, therefore, bases of various length, breadth and height are possible, corresponding to the fixing points in different vehicle cabs.

When a vehicle cab is placed in the straightening jig, the alignment bars 2 are adjusted in the longitudinal and transverse directions so that the given bearing component in the front part of the vehicle can engage between the bearing plates 22 in the respective bearing fixings 23 on the alignment bars 2 and be locked therein via the axle pins 23. After this, the brackets 34 are fixed in the back part of the vehicle cab and the cab is lowered until it rests on the straightening jig so that the conical guides formed on the underside of the brackets come to rest on the guide studs 31 on the upright beam 25. The rear fixing points in a vehicle cab are usually not displaced in relation to each other and therefore the back part of the cab can be clamped in the straightening jig with the aid of the levers 41 and the previously-mentioned clamping components 42 and/or wedges 45. The front fixing points of the cab can, however, be displaced relative to each other and to the rear fixing points. Under these conditions it is usual first to clamp the rear part of the cab in the straightening jig before the alignment bars 2 by lateral displacement and longitudinal displacement make it possible for the front bearing components of the cab to engage in the bearing fixings 24 on the alignment bars 2. After this the hydraulic cylinder 18 is put in place on the longitudinal beam 4 of the lower frame 5 and, supported on the transverse beams 8 in the upper frame 6, influences the alignment bars 2 via the end pieces 17 so that they carry out longitudinal displacement movements. In the same way, the hydraulic cylinder 11 is fitted on the transverse beams 8 of the upper frame 6 and, supported on its respective end pieces 10 and the central support 12, influences the alignment bars 2 to carry out transverse displacement movements. These displacement movements of the alignment bar 2 in the longitudinal and transverse direction are carried out until the pins 20, 21 can be introduced in the guide rails and guide holes provided on the alignment bars 2. When this happens, the fixing points of the vehicle cab can be regarded as having taken up their original positions relative to each other.

In certain cases it may be necessary both before and after straightening operations to correct distortion in a cab structure. With the straightening jig according to the invention this can be done with the aid of servo-controlled auxilliary devices. For this purpose, on the outside of the respective outer vertical beam elements 27 in the upright beam 25 two outwardly projecting lugs 46 are arranged pairwise, forming bearing fixings 47 for either a vertically fitted hydraulic cylinder 48 or a link 49. The piston of the hydraulic cylinder 48 is connected via a fork-shaped connecting link 50 and a pin 52 to a follower 51 which is welded both to the underside and to the outer edge surface of the bracket 34. When force is applied to the rear part of the cab under the effect of the hydraulic cylinder 48 it is necessary first to release the clamping devices 42, 45, which act on the levers 41 to lock the brackets 34 at a fixed height. When such a straightening operation is carried out it is generally only one of the brackets 34 which is made to lift and as a counter-effect affects thereby a link 49 attached to the follower 51 on the other bracket 34, the other end of the link being connected to the bearing fixing 47.

The invention is not confined to the construction form given by way of example, but can be modified in various ways within the scope of the Patent Claims which follow hereafter, including single fixings, and preparatory straightening operations for vehicle bodies with different dimensions in their length, breadth and height, and with various distances between the bearing components and fixing points selected in the respective body.

I claim:

1. A straightening jig for vehicle bodies, said straightening jig comprising a stand for fastening to a foundation, and being equipped with a number of bearing fixings in which a number of bearing components on a vehicle body to be straightened may be fixed when said vehicle body is in position on said straightening jig, the improvement wherein (1) said stand is provided with guideways for at least one alignment bar arranged displaceably in said straightening jig and having extension in the longitudinal direction of said straightening jig, and (2) said alignment bar is provided with at least one bearing fixing in which a bearing component on said vehicle body may be fitted when said vehicle body is placed in said straightening jig, said alignment bar being arranged so that it can carry out displacement movements in said guideways both in the logitudinal direction of said alignment bar and in its transverse direction, preferably with the aid of servocontrolled operating devices, and wherein the relative position of said alignment bar in said stand can be locationally fixed when said alignment bar is moved into a given position for said bearing components of said vehicle body in position in said straightening jig.

2. A straightening jig according to claim 1, the improvement wherein said straightening jig comprises two displaceably arranged alignment bars, each of said alignment bars being arranged in a fixed guideway in said stand, said alignment bars being arranged in substantially parallel positions relative to one another with a distance between them which corresponds generally to the distance between the two front bearing components of said vehicle body.

3. A straightening jig according to claim 1 or 2, the improvement wherein each alignment bar has guide tracks and/or guide holes for locking said alignment bars, for example, by means of pins, in a specific position corresponding to a given position in said stand.

4. A straightening jig according to claim 1, the improvement wherein said stand consists of a lower frame and an upper frame rigidly connected to each other, each of the frames comprising at least two logitudinal beams and at least two transversely extending beams forming an inner rectangular frame with said transverse beams projecting out freely at the sides of the respective inner frames.

5. A straightening jig according to claim 4, the improvement wherein said transverse beams of said upper frame are located inside the transverse beams of said lower frame, and said upper frame is connected in the transverse direction symmetrically to said lower frame so that the logitudinal beams of said upper frame are located inside the logitudinal beams of said lower frame.

6. A straightening jig according to claim 4 or 5, the improvement wherein (1) said transverse beams of said upper frame have upright end pieces on their ends, (2) said transverse beams are provided in their respective centers with an upright support, and (3) said end pieces and support form a supporting mounting for a servo-controlled operating device arranged in the logitudinal direction of said transverse beams.

7. A straightening jig according to claim 6, the improvement wherein each displaceable alignment bar has on its ends downward pointing end pieces, on which a servo-controlled operating device fitted in the logitudinal direction of the alignment bar is designed to press, to move the alignment bar relative to the stand.

8. A straightening jig according to claim 1 or 2, the improvement wherein the rear part of said stand comprises an upright bean with two seats formed on its upper face for stud-mounting the rear part of said vehicle body.

9. A straightening jig according to claim 8, the improvement wherein said upright beam is provided with two bearing fixings in which levers are mounted rotatably for clamping the rear part of said vehicle body.

10. A straightening jig according to claim 9, the improvement further comprising transverse wedges fitted between the respective bearing plates on said bearing fixing with ends of said wedges being fitted into a track in said respective bearing plates, and including means for forcing said wedges down onto said levers so as to effect said clamping.

11. A straightening jig according to claim 8 in combination with a vehicle body to be straightened, said vehicle body being mounted on said upright beam by means of two brackets attached to the rear fixing points of said body by screw connections.

12. A straightening jig according to claim 11, the improvement wherein each of said brackets has a conical recess on its respective lower face, said recess being arranged to fit over corresponding guide studs attached to said upright beam when said vehicle body is in position on said straightening jig.

13. A straightening jig according to claim 8, the improvement wherein said upright beam is provided with a fixed bearing fitting for a a servo-controlled operating device connected between said upright beam and a fixed follower on said bracket.

14. A straightening jig according to claim 9, the improvement further comprising a servo-controlled operating device attached adjacent one end thereof to the lower arm of said lever and supported adjacent its other end on said upright beam, said servo-controlled operating device being arranged so as to effect said clamping.

15. A straightening jig according to claim 14, the improvement wherein said levers are arranged to lock said brackets at a fixed height relative to said upright beam except when said servo-controlled operating device is activated.

16. A straightening jig according to claim 8, the improvement wherein said upright beam is provided with a fixed bearing fitting for a link connected between a said upright beam and a fixed follower on said bracket.

* * * * *

UNITED STATES PATENT AND TRADEMARK OFFICE

CERTIFICATE OF CORRECTION

PATENT NO. : 4,249,409

DATED : February 10, 1981

INVENTOR(S) : Mojkas J. Samuelsson

It is certified that error appears in the above-identified patent and that said Letters Patent are hereby corrected as shown below:

Claim 1, Column 7, line 32: The term "longitudinal" should be substituted for "logitudinal".

Claim 4, Column 7, line 57: The term "longitudinal" should be substituted for "logitudinal".

Claim 8, Column 8, line 20: The term "beam" should be substituted for "bean"

Claim 13, Column 8, line 47: Cancel the term "a" (second occurrence).

Signed and Sealed this

*Twenty-sixth* Day of *May 1981*

[SEAL]

*Attest:*

RENE D. TEGTMEYER

*Attesting Officer*

*Acting Commissioner of Patents and Trademarks*